US005988559A

United States Patent [19]

Gnass

[11] Patent Number: 5,988,559

[45] Date of Patent: Nov. 23, 1999

[54] FIRE HOSE WINDING APPARATUS

[76] Inventor: Justin A. Gnass, P.O. Box 3344, Chico, Calif. 95927

[21] Appl. No.: 09/113,936

[22] Filed: Jul. 10, 1998

Related U.S. Application Data

[60] Provisional application No. 60/057,590, Aug. 29, 1997.

[51] Int. Cl.[6] ..... B65H 18/08

[52] U.S. Cl. ..... 242/537; 242/395; 242/399.2; 242/546.1; 242/577.3

[58] Field of Search ..... 242/577, 577.2, 242/577.3, 577.4, 532.6, 537, 539, 546.1, 395, 395.1, 399, 399.2, 401, 403, 404, 406, 407, 407.1; 137/355.26, 355.27

[56] References Cited

U.S. PATENT DOCUMENTS

| | | | |
|---|---|---|---|
| 146,558 | 1/1874 | Totten | 242/577.3 |
| 584,264 | 6/1897 | Elder | 242/577.3 |
| 718,194 | 1/1903 | Delphey | 242/577 |
| 1,108,726 | 8/1914 | Eichhoff | 242/407 |
| 1,252,483 | 1/1918 | Pattison | 242/577.3 |
| 1,281,802 | 10/1918 | Madill | 242/577.4 |
| 2,510,394 | 6/1950 | Fong | 242/407 |
| 2,517,723 | 8/1950 | Schoditsch | 242/577.3 |
| 2,960,279 | 11/1960 | Little | 242/532.6 |
| 2,964,258 | 12/1960 | Kutil | 242/399.2 |
| 3,168,260 | 2/1965 | Kittleson | 242/546.1 |
| 4,265,414 | 5/1981 | Spradling | 242/532.6 |
| 4,390,141 | 6/1983 | Webster | 242/404.2 |
| 4,475,698 | 10/1984 | Militello | 242/532.6 |
| 4,592,519 | 6/1986 | Peacock | 242/532.6 |
| 5,033,690 | 7/1991 | McIver | 242/532.6 |
| 5,205,509 | 4/1993 | Noggle | 242/406 |
| 5,666,992 | 9/1997 | Robins | 242/407 |

OTHER PUBLICATIONS

L. N. Curtis & Sons Catalog (date unknown) p. 141, advertisement for "Forester® Hose Roller".

L. N. Curtis & Sons Catalog (date unknown) p. 153, advertisement for "Hannay Reels".

Cascade Fire Equipment Company catalog (date unknown) p. 78, advertisement for the Sidewinder Hose Roller.

Wildfire Halprin catalog (date unknown) p. 102, advertisement for "The E–Z Way Fire Hose Roller".

*Primary Examiner*—John M. Jillions

*Attorney, Agent, or Firm*—Lothrop & West

[57] ABSTRACT

A fire hose winding apparatus. The apparatus includes an elongated, horizontal frame, or extension arm, having an inner end detachably coupled to a fire truck, or other available support. A horizontal spindle extends transversely from an outer end of the frame. A hub assembly is mounted for rotation on the spindle and threadably secured thereon with a fastener knob. The hub assembly includes a centrally positioned hub and a plurality of radially extending hub arms. Hose arms are detachably and adjustably coupled to the outer ends of each hub arm. The outer extremity of each hose arm is provided with an L-shaped hose catcher bracket. The hose arms are set at a predetermined radially extending distance from the hub, to provide a support and forming frame for the fire hose. A cranking handle is detachably coupled to a selected hose arm. An end portion of the fire hose is placed over one of the catcher brackets, and the handle is rotated to wind successive layers of hose over the form provided by the brackets.

24 Claims, 5 Drawing Sheets

FIRE HOSE WINDING APPARATUS

CROSS-REFERENCE TO RELATED APPLICATION

On Aug. 29, 1997, the applicant herein filed a provisional patent application, Ser. No. 60/057,590, disclosing the same subject matter of the present application. Applicant hereby claims the benefits of 35 U.S.C. Section 119(e), respecting his filing of and reference to this provisional application.

BACKGROUND OF THE INVENTION

1. Field of the Invention

The invention relates generally to fire hose winding devices, for arranging sections of fire hose into a compact and manageable form. More specifically, the invention pertains to a fire hose winding apparatus which is specially adapted for winding hose in the field, into an expanded hoop configuration.

2. Description of Prior Art

Fire hoses must be capable of reliably withstanding very high water pressures, under adverse environmental conditions. Typically 100' or less in length, fire hoses are manufactured by combining an inner rubber tube with a protective, exterior woven fabric. Heavy brass fittings are included at each end, for attachment to another hose, a pump, or a nozzle. Owing to these physical characteristics, fire hoses are cumbersome to manage and use. Consequently, various winding and packaging techniques have been developed over the years for the storage, transport, and deployment of such hoses.

Most of the prior art hose winding devices employ a rotatable hub, about which one end of the hose is initially attached. The hub may be rotated by a variety of driving means, including hand cranks, foot operators, and electric motors. As the hub is rotated, successive layers of hose are wrapped in concentric fashion to form a tight, circular bundle.

Concentric hose winding devices are used both at the fire station and in the field. At the fire station, a free-standing base, including a horizontal axle, is used to support the rotatable hub as the concentric hose bundle is formed. For field winding, a concentric winding device is carried on the fire truck. Vertical support posts are provided on either the front or the rear bumper of the fire truck. The frame of the winding device includes a detachable coupling mechanism, for connection to a support post on the truck. In a matter of minutes, the concentric winding device is assembled on the truck, and is ready for operation.

Such a field winder allows the fire fighter to undertake the hose winding operation immediately after the fire is over, or when there is an available rest period during an extended fire operation. This ensures that the fire hoses are ready for another fire without having to return to the station. Also, by winding the hoses in the field, storage and transport of the hoses on the truck are facilitated.

The concentric winding technique results in a relatively compact bundle of hose. However, this "donut roll ", as it is sometimes termed, cannot later be bent or manipulated into alternative shapes for carrying on a backpack, or the like. Although compact for storage on the fire truck, the size and configuration of a concentric roll makes it difficult to be carried by fire fighters in the field. Also, the concentric roll is inefficient to deploy, as the entire roll must be unwound before it can be charged with water. In critical situations, the time it takes for an individual to unroll a 100' bundle of hose can result in loss of control of a fire which otherwise might have been stopped. Such a circumstance may arise during protection of a structure, or in wildland firefighting under conditions of high winds.

Thus, other methods have been developed for winding and deploying fire hose. Instead of winding the hose into a tight, solid roll, the hose may be wound into an expanded hoop configuration. With a fairly large aperture in the center of the wound roll, the hoop is readily folded into a horseshoe shape, and bound by a number of nylon cords or straps. After winding and binding two hoses in this manner, the hoses are stacked and bound together, resulting in what is known as a Gnass pack. This pack was named after its developer, Jan Gnass, a firefighter for the California Department of Forestry.

The Gnass pack has a shape and configuration which is readily adapted for backpack transport by a firefighter. Such a pack arrangement has the additional advantage of rapid deployment in the field. For example, it is not necessary that the entire roll be unwound for usage, unless an entire 100' or more run is necessary to reach the fire. Ancillary to this feature, the hoop configuration does not need to be completely unrolled before usage. The firefighter only needs to connect one end to the pump discharge, attach a nozzle to the other end, run out the length of hose needed, and charge the system with water.

As mentioned above, the Gnass pack, including the related Gasner, Jarbo, and Cleveland packs, relies upon arranging the hose into an expanded hoop configuration. Although this hose arranging can be done manually, on the ground, this is a time consuming operation. Proper manipulation of the 100' hose also requires a fair amount of skill and practice, as well.

There are several commercially available winders adapted for arranging fire hose in an expanded hoop configuration. However, these winders are designed for use with a fat freestanding base, and are not easily transported on a fire truck for field operation.

Another winder, which is typically homemade by firefighters themselves, consists of two pieces of 2"×4" wood material, attached together at their centers to form a symmetrical cross. A bore at the center point of the cross defines the axis of rotation for the winder. An upright member includes a horizontal rod or bolt at its upper end. The bolt passes through the bore of the cross, and serves as an axle for the assembly.

The fire hose is placed onto one of the four outermost ends of the cross, and the cross is rotated about its axis. The entire length of hose is wound onto the cross form, in successive layers, creating the expanded hoop shape. The hose is then carefuilly drawn away from the winder, and laid onto the ground or other flat surface for binding. While this type of winder is simple and works relatively well, it is neither lightweight nor easily transportable.

Thus, one object of the present invention is to provide a winder which can arrange fire hose in an expanded hoop configuration, and which is also adapted for field use.

Another object of the invention is provide a winder which is lightweight and compact when disassembled, for placement in the storage compartment of a fire truck, yet can be assembled in minutes in the field for operation.

Another object of the invention is to provide a winder which does not require a freestanding base, and may be used in conjunction with existing support posts on the fire truck bumpers, or other existing support structures in the field.

Yet another object of the invention is to provide a winder which has selectively positionable arms, for creating expandable hoops of a predetermined, desired size.

Yet another object of the present invention is to provide a winder which can be mounted on either side of its support frame, for flexibility in operation.

These and other objects and features of the present invention will be apparent from the disclosure set forth below.

SUMMARY OF THE INVENTION

The fire hose winding apparatus of the present invention includes an elongated, horizontal frame, or extension arm, having an inner end detachably coupled to a fire truck, or other available support structure. A horizontal spindle, having two receiving ends, extends transversely from the outer end of the frame.

A hub assembly is mounted for rotation on a selected receiving end of the spindle, and is threadably secured thereon with a fastener knob. The hub assembly includes a centrally positioned hub, and a plurality of radially extending hub arms.

Hose support arms are detachably coupled to the outer ends of each hub arm. The outer extremity of each hose support arm is provided with an L-shaped hose catcher bracket. The hose support arms are set at a predetermined, radially extending distance to provide a forming frame for the fire hose. A handle assembly is detachable coupled to a selected hose arm. The handle assembly includes a hose coupling retainer.

The end of the fire hose having the male coupler is placed within the coupling retainer and draped over one of the catcher brackets. The handle is rotated to wind the hose over the form provided by the brackets. After the winding is completed, the expanded hoop of fire hose is withdrawn from the winder, and placed on a flat surface in readiness for binding and incorporation into a firefighter's backpack.

DETAILED DESCRIPTION OF THE PREFERRED EMBODIMENT

Figures 1, 2:
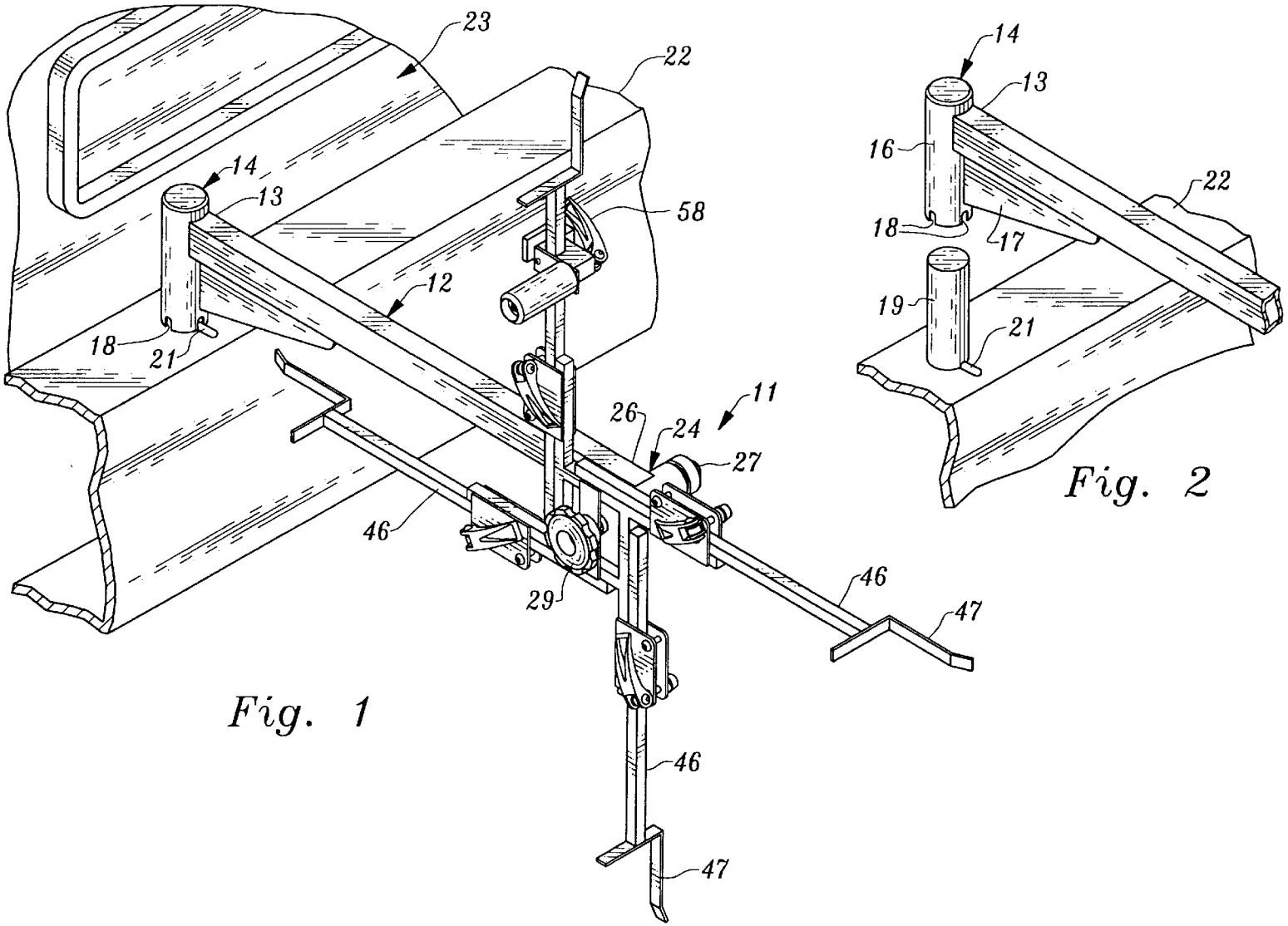
FIG. 1 is a right front perspective, showing the fire hose winding apparatus mounted on the bumper of a fire truck.
FIG. 2 is a detail of the post and tube attachment system.
Figure 3:
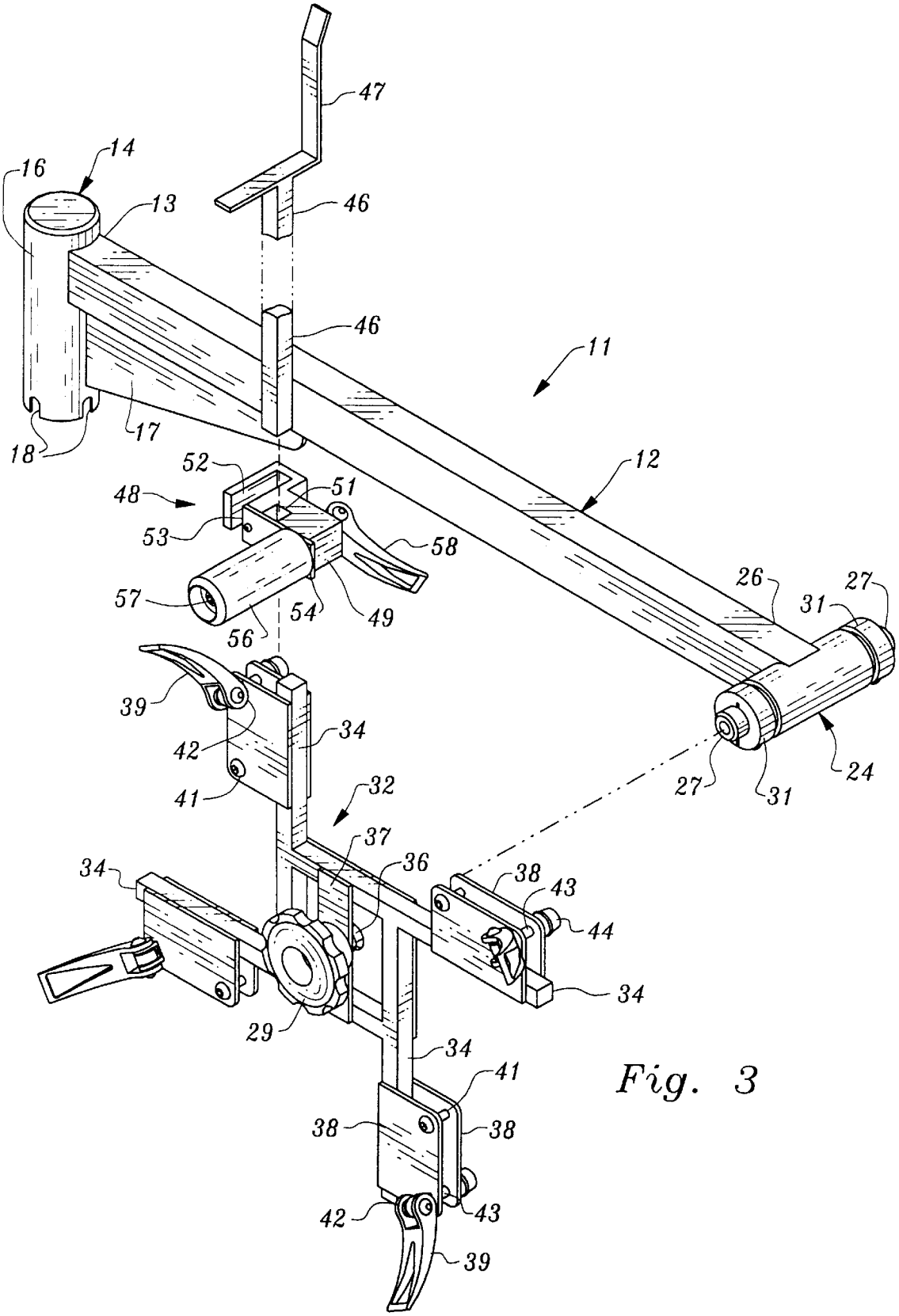
FIG. 3 is an exploded assembly drawing, showing the extension arm, the hub assembly, the crank mechanism, and a fragment of a hose arm.
Figure 4:
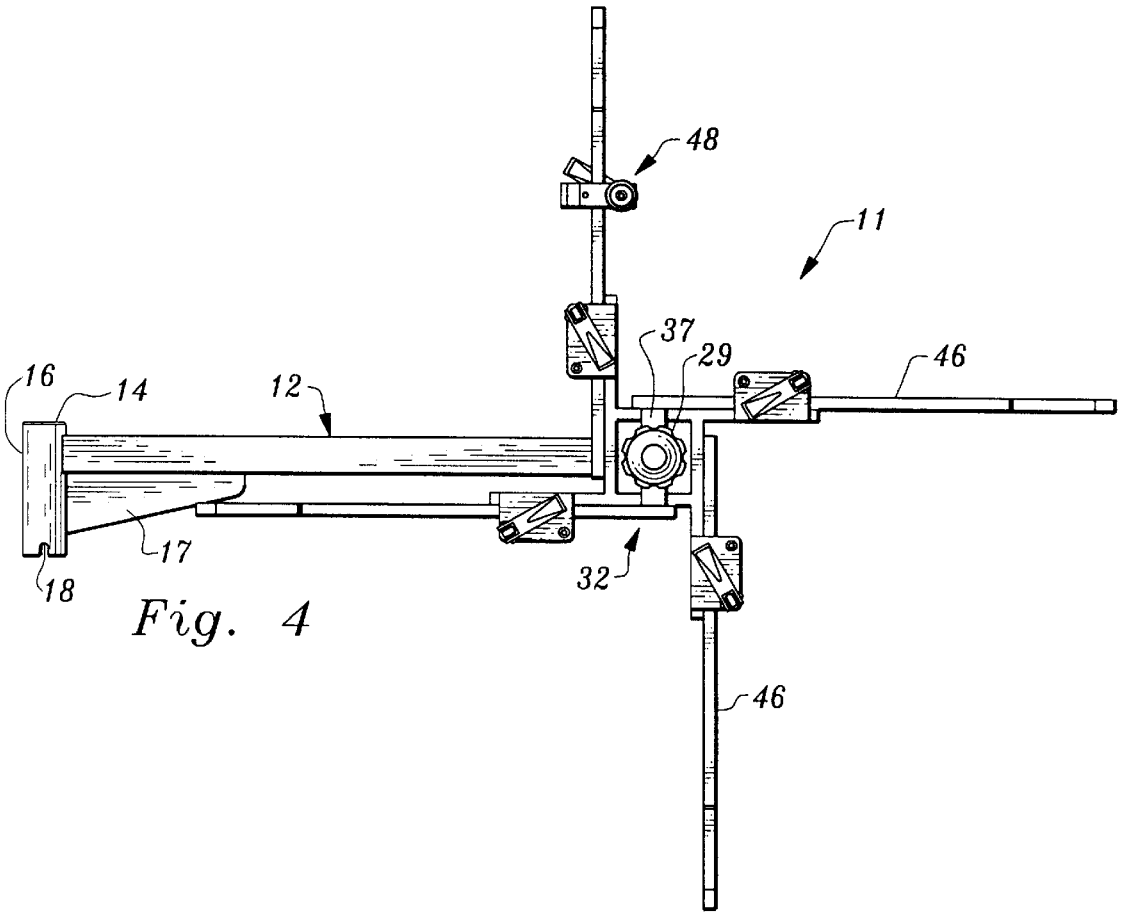
FIG. 4 is a side elevational view of the winding apparatus.

Turning now to FIG. 1 of the drawings, a fire hose winding apparatus 11 includes an elongated frame 12, or extension arm. An inner end 13 has a detachable coupler 14, comprising a vertical tube 16 secured to frame 12 with a gusset plate 17. Plural U-shaped registration notches 18 are provided in spaced relation, every 90 degrees around the lower edge of tube 16.

Tube 16 slides over a vertical post 19. A registration pin 21 extends outwardly from the base of post 19. Typically, a post 19 is mounted either on the front or the rear bumper 22 of a fire truck 23. Prior art fire hose winders, designed to form concentric rolls, have previously been mounted on such posts, for performing field winding of hoses.

Figure 5:
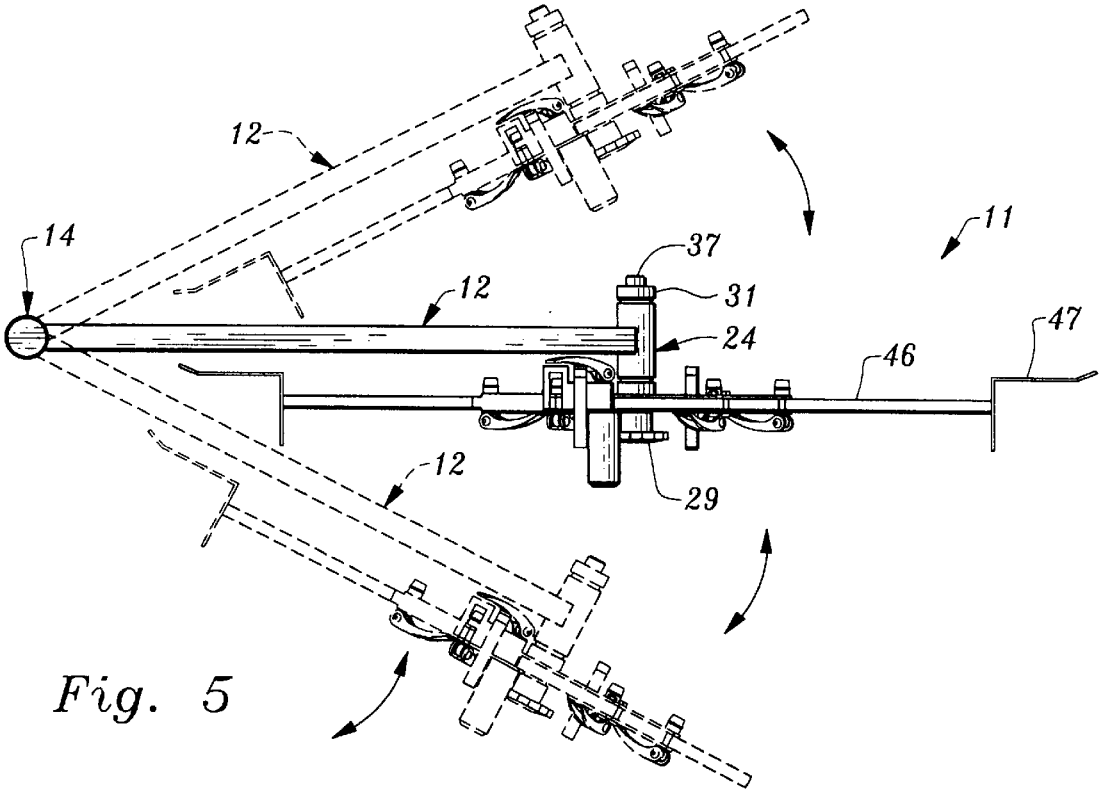
FIG. 5 is a top plan view, showing in broken line alternate movement of the winding apparatus about the vertical axis of its support coupler.

By locating a selected notch 18 over the registration pin 21, the user can locate the extension arm in the desired orientation with respect to the truck 23 (see, FIG. 5). While undertaking a hose winding operation, arm 12 will usually be positioned so it is extending outwardly, or normal to bumper 22. However, by lifting the extension arm slightly so that the notch clears the pin, and rotating the apparatus 90 degrees in either direction about the axis of its detachable coupler, the winding apparatus may be locked into a position parallel to the side of the truck. If post 19 is mounted on a trailer extension so that the inner end of frame 12 is horizontally spaced from the bumper, winding can also take place in these alternative positions of the apparatus.

Although this means of coupling the apparatus to the existing support post on the truck has proven convenient, other alternative means may be used to couple the apparatus to the truck. For example, the extension arm could be fitted with a square tube for attachment to a trailer hitch receiver. Such receivers are often welded to front and rear bumpers of fire trucks for performing a variety of pushing or pulling operations with trailers.

It is also contemplated that the apparatus could be secured to some other available structure at the field site, such as an existing tree, post, or other vertically extending member. Such an alternative support arrangement would not diverge from the inherent advantages offered by the present fire hose winding apparatus.

A tubular spindle shell 24 is preferably fixed upon an outer end 26 of extension arm 12. Although the shell 24 may be located on arm 12 at a location other than its outer end, it must be spaced a sufficient distance from the inner end of the arm, so that mechanical interference does not occur when the winding operation takes place.

A spindle 27 passes through shell 24, and extends outwardly from either end of the shell. Circular shoulder bushings (not shown) are press fitted within both ends of shell 24. These bushings locate the horizontal axis of the spindle in a manner which is transverse with respect to extension arm 12. Each end of the spindle includes a threaded bore for receiving the threaded shaft 28 of a knob 29. Compressive locking collars 31 are positioned over respective portions of both ends of spindle 27, to secure the spindle within shell 24 in centered and locked relation.

Winding apparatus 11 also includes a hub assembly 32 comprising a square hub plate 33, and four extending hub arms 34. Although as few as two hub arms could be used to practice the invention, it is preferred to use four such arms because the hose is better supported during winding and the resultant extended hoop is more uniformly arranged.

Figure 6:
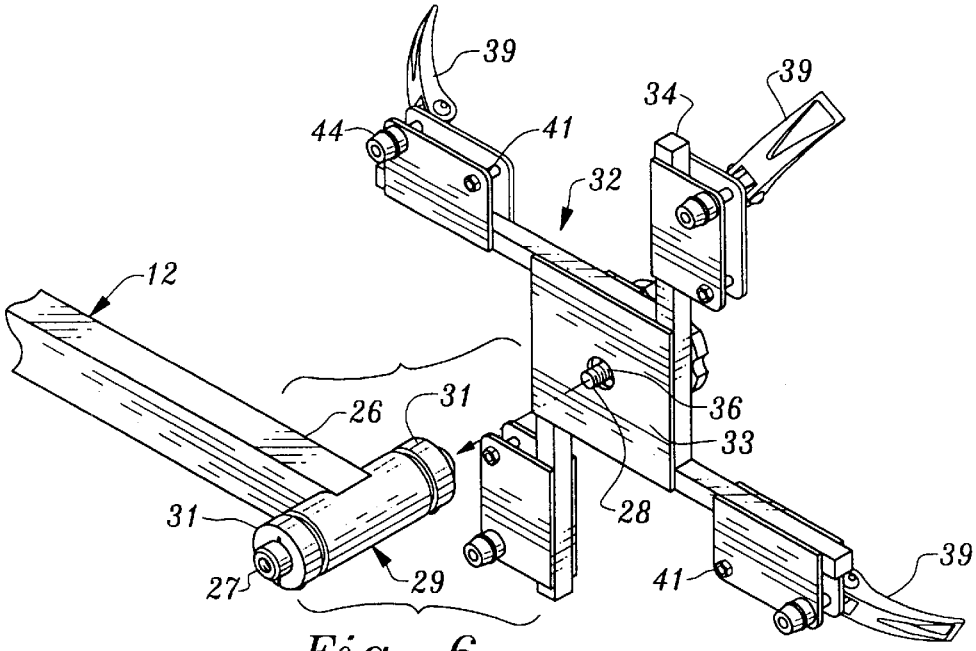
FIG. 6 is an exploded assembly drawing, showing the method of attaching of the hub to either side of the spindle.

Plate 33 includes a central aperture 36, sized and configured to accommodate and pass, an end of spindle 27 (see, FIG. 6). Spanning two parallel hub arms is a hub bridge 37. Threaded shaft 28 of knob 29 passes through a centrally positioned hole (not shown) within the bridge, for threadably engaging a selected end of the spindle 27. In this manner, hub assembly is attached to extension arm 12, for rotation about spindle 27. And, because spindle 27 has two threaded bores, the hub assembly can be mounted on either side of extension arm 12.

Figure 7:
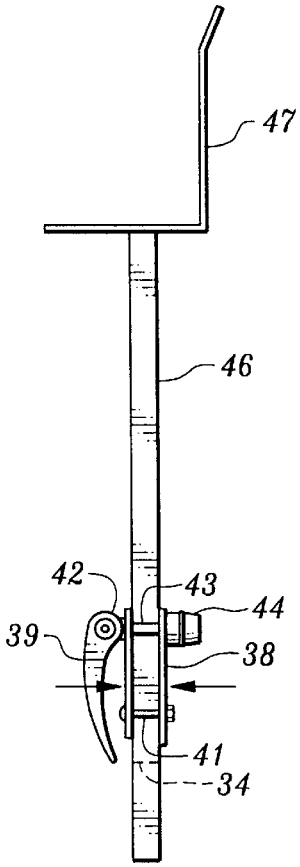
FIG. 7 is an elevational view of the hose arm and a respective hub arm, with the clamp in a locked position.

Pairs of parallel, opposing pinch plates 38 are welded to the outer end extremities of hub arms 34. Pinch plates 38 include a locking handle 39 and a guide bolt 41. Handle 39 includes a cam surface 42, effective to translate shaft 43 and nut 44 from a locked position (FIG. 7) to an unlocked position (FIG. 8), when handle 39 is rotated about its pivot shaft.

Figure 8:
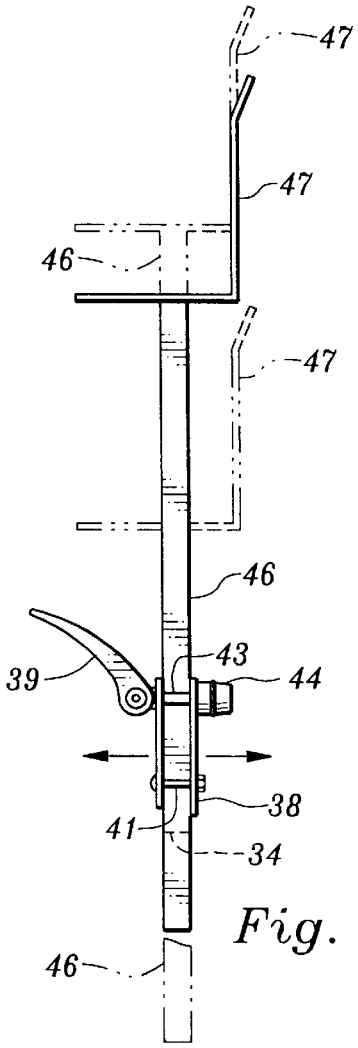
FIG. 8 is a view as in FIG. 7 with the clamp in an unlocked position.

With handle 39 in an unlocked position, a hose support arm 46 is inserted within the pinch plates 38 of each hub arm. As shown in FIG. 8, the support arm 46 is installed between the plates and below guide bolt 41. An L-shaped hose catcher bracket 47 is welded to the end of each arm 46. Each support arm is preferably positioned and locked within a respective pinch plate, so that the radial distance between the axis of the hub assembly and the foot of the catcher bracket is the same for each arm. By adjusting this radial distance, the size of the resultant hose hoop is predetermined.

It is apparent that other adjustable locking mechanisms can be used to interconnect hub arms 34 with hose support arms 46. For example, a crimping mechanism operated by rotating a knob or handle is an obvious substitution for the cam-actuated mechanism shown herein. It may also be advantageous to use a sliding telescopic arrangement between the arms, with pins or bolts, and plural holes therein for selective adjustment of the radial distance.

It is also contemplated that the hub arms could be eliminated, or modified into short receivers integrated within a much smaller hub assembly. This would allow the hose support arms to be attached directly to the hub, or coupled within the short receivers. The disadvantage of such an arrangement is that the range of radial adjustment of the hub arms would be somewhat limited.

A combined crank and hose end retainer assembly 48 is mounted to a selected support arm 46. A block 49 is machined to include a hose support arm channel 51 and a hose coupler retainer 52. A bolt 53 secures one end of pinch plate 54 to block 49. Plate 54 thereby closes the open side of channel 51, surrounding arm 46 on all sides.

A crank handle 56 is supported for rotation about an axle 57. Axle 57 extends through holes in plate 54 and block 49 to connect with the pivot shaft of locking handle 58. A cam surface is provided on handle 58 which is identical to that already described for locking handle 39. As a consequence, with handle 58 in an unlocked position, arm 46 can freely pass through channel 51. Once arm 46 is secured in place and retainer assembly 48 is positioned where desired, locking handle 58 is moved to a locked position, drawing axle 57 toward the handle. An axle stop nut (not shown) compresses plate 54 against arm 46, securing assembly 48 to the arm.

Figure 9:
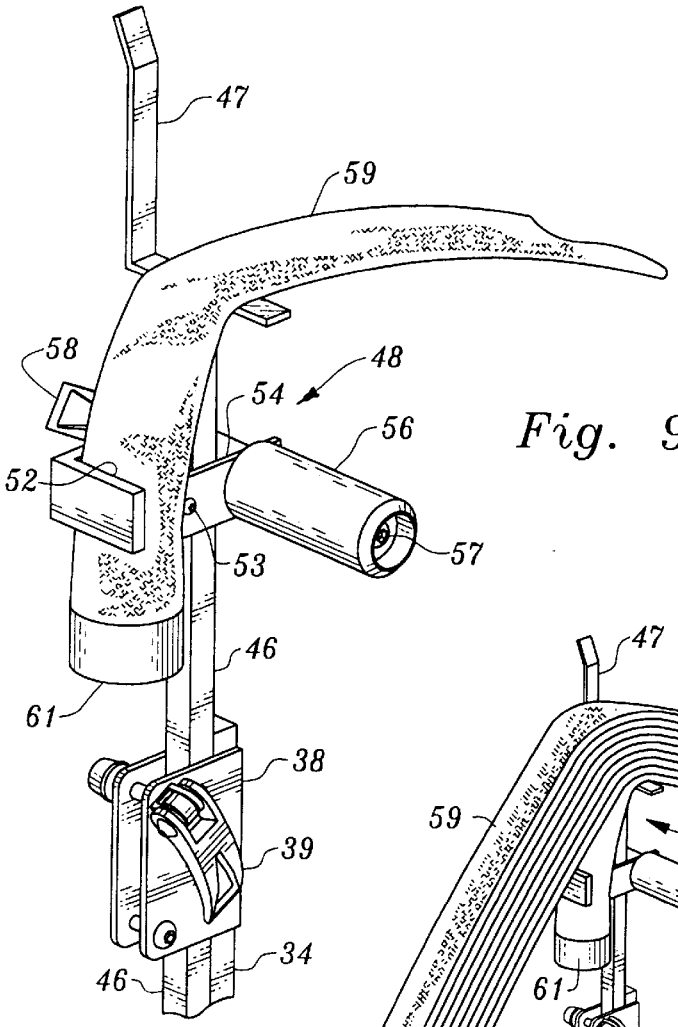
FIG. 9 is a perspective view of the end of a fire hose inserted within the hose coupling retainer; and, FIG. 10 is a perspective view of a fire hose fully wound onto the hose brackets, forming an extended hoop configuration.
Figure 10:
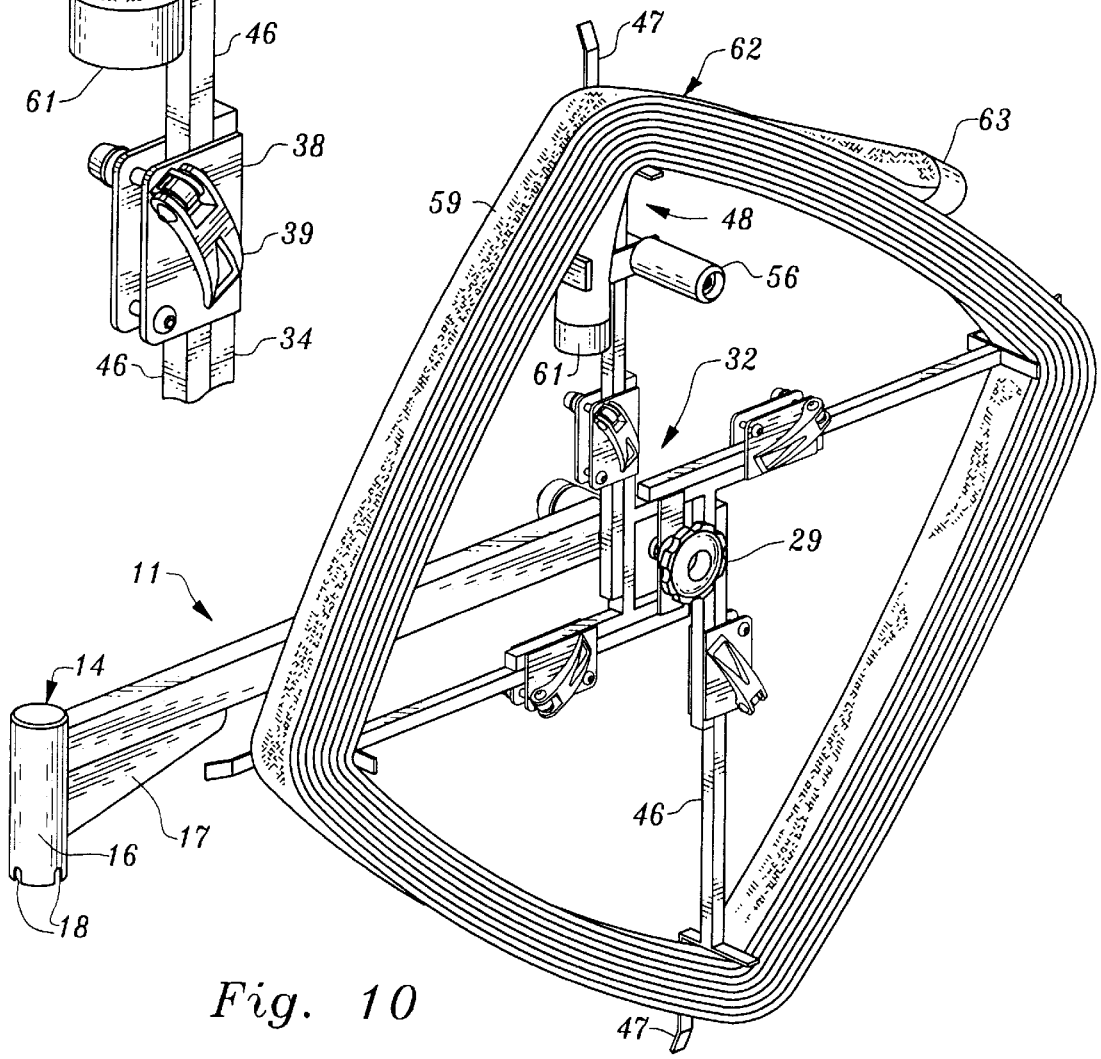

The end of a fire hose 59 having a male coupler 61, is now installed within retainer assembly 48. Making particular reference to FIG. 9, the end of hose 59 is slid within retainer 52, with coupler 61 spaced just below the retainer. The hose is passed upwardly, and is draped over the foot of bracket 47. Grasping crank handle 56, the fire fighter begins rotation of the handle and the connected hub assembly 32. Successive rotations of the handle result in a completed expanded hoop 62, with a female coupler 63 left on the outermost loop of hose (see, FIG. 10). The hoop 62 is then withdrawn from the winding apparatus, laid on a flat surface in a horseshoe configuration, and bound with nylon cord or straps.

It will be appreciated, then, that I have described a fire hose winding apparatus which is compact, lightweight, and simple to operate, yet provides field winding of fire hose into an expanded hoop configuration, ready for incorporation into a firefighter's backpack.

What is claimed is:

1. An apparatus for winding fire hose in an expanded hoop configuration, comprising:

a. a frame, having an inner end and an outer end;

b. coupler means attached to said inner end of said frame, for detachably connecting said frame to a support post;

c. a spindle attached to said frame;

d. a hub assembly rotatably mounted on said spindle, said hub assembly including at least two hose support arms extending radially therefrom a predetermined distance and about which the fire hose is wound, said predetermined distance being sufficient so as to allow the fire hose, when wound into an expanded hoop configuration, to be folded into a horseshoe shape; and, e. a crank handle attached to said hub assembly.

2. An apparatus as in claim 1 in which said hub assembly further includes at least two hub arms, and in which said hose support arms are detachably and adjustably coupled to said hub arms.

3. An apparatus as in claim 1 in which said coupler means includes a tube having a vertical portion and said post is attached to a fire truck, said tube being sized and configured to receive said post, and further including locking means to secure said tube at a predetermined rotational position on said post.

4. An apparatus as in claim 1 including four hose support arms, spaced every 90 degrees around said hub assembly.

5. An apparatus as in claim 4 in which said hub assembly further includes four hub arms and means on an outer extremity of each of said hub arms for detachably and adjustably coupling each said hub arm to a respective one of said hose support arms.

6. An apparatus as in claim 5 in which said means for detachably and adjustably coupling comprises a cam-actuated handle and a pair of pinch plates.

7. An apparatus as in claim 1 in which a hose catcher bracket is attached to an end of each said hose support arm.

8. An apparatus as in claim 1 in which said crank handle is attached to a selected said hose support arm.

9. An apparatus as in claim 8 in which said crank handle further includes a hose coupler retainer.

10. An apparatus as in claim 1 in which said spindle has a horizontal axis, and is mounted on said outer end of said frame.

11. An apparatus as in claim 1 in which said spindle has two ends, and in which said hub assembly can be rotatably attached to a selected one of said spindle ends.

12. An apparatus for winding fire hose into an expanded hoop configuration, comprising:

a. a frame, having an inner end and an outer end;

b. a coupler attached to said inner end, said coupler being detachably connected to a post secured to a fire truck;

c. a spindle attached to said frame, at a location remote from said inner end; and, d. a hub assembly rotatably attached to said spindle, said hub assembly including a plurality of hose support arms about which the fire hose is wound, said support arms radially extending from said hub a predetermined distance sufficient so as to allow the fire hose, when wound into an expanded hoop configuration, to be folded into a horseshoe shape.

13. An apparatus as in claim 12 in which said coupler includes a tube having a vertical portion, said tube being sized and configured to receive said post, and further including locking means to secure said vertical portion within said post at a predetermined rotational position.

14. An apparatus as in claim 12 in which said hose support arms are radially adjustable in length, so that the size of the expanded hoop is adjustable and predetermined.

15. An apparatus as in claim 12 in which said spindle has two ends and said hub assembly can be attached to a selected one of said spindle ends.

16. An apparatus as in claim 12 including a crank handle attached to a selected one of said hose support arms.

17. An apparatus for winding fire hose into an expanded hoop configuration, comprising:

a. a frame having an inner end and an outer end;

b. a post;

c. a coupler between said inner end and said post; and, d. a hub assembly mounted for rotation on said frame, said hub assembly including radially extending means for supporting and forming a length of fire hose in an expanded hoop configuration in which the hoop has a sufficiently large central aperture so that the wound hose may be folded into a horseshoe shape.

18. An apparatus as in claim 17 in which said means for supporting and forming a length of fire hose is adjustable, so as to make the size of the expanded hoop adjustable and predetermined.

19. An apparatus as in claim 17 in which said means for supporting and forming a length of fire hose comprises a hub, a plurality of hub arms extending radially from said hub, a plurality of hose support arms, and means for adjustably coupling each of said hub arms to a respective one of said support arms.

20. An apparatus as in claim 17 in which said post is mounted on a bumper of a fire truck.

21. An apparatus for winding fire hose in an expanded hoop configuration, comprising:

a. a frame, having an inner end and an outer end;

b. frame coupler means attached to said inner end of said frame, for detachably connecting said frame to a support post;

c. a spindle attached to said frame;

d. a hub assembly rotatably mounted on said spindle, said hub assembly including four hose support arms extending radially therefrom a predetermined distance and about which the fire hose is wound, said hose support arms being spaced every 90 degrees around said hub assembly;

e. four hub arms, including means on an outer extremity of each of said hub arms for detachably and adjustably coupling each said hub arm to a respective one of said hose support arms, and in which said hub arm coupling means comprises a cam-actuated handle and a pair of pinch plates; and, f. a crank handle attached to said hub assembly.

22. An apparatus for winding fire hose in an expanded hoop configuration, comprising:

a. a frame, having an inner end and an outer end;

b. coupler means attached to said inner end of said frame, for detachably connecting said frame to a support post;

c. a spindle attached to said frame;

d. a hub assembly rotatably mounted on said spindle, said hub assembly including at least two hose support arms extending radially therefrom a predetermined distance and about which the fire hose is wound; and, e. a crank handle, said crank handle being attached to a selected said hose support arm and including a hose coupler retainer.

23. An apparatus for winding fire hose in an expanded hoop configuration, comprising:

a. a frame, having an inner end and an outer end;

b. coupler means attached to said inner end of said frame, for detachably connecting said frame to a support post;

c. a spindle attached to said frame, said spindle having two ends;

d. a hub assembly rotatably attached to a selected one of said spindle ends, said hub assembly including at least two hose support arms extending radially therefrom a predetermined distance and about which the fire hose is wound; and, e. a crank handle attached to said hub assembly.

24. An apparatus for winding fire hose into an expanded hoop configuration, comprising:

a. a frame, having an inner end and an outer end;

b. a coupler attached to said inner end, said coupler being detachably connected to a post secured to a fire truck;

c. a spindle attached to said frame at a location remote from said inner end, said spindle having two ends; and, d. a hub assembly rotatably attached to a selected one of said spindle ends, said hub assembly including a plurality of radially extending hose support arms about which the fire hose is wound.

* * * * *